US005673578A

United States Patent [19]

Roos

[11] Patent Number: 5,673,578

[45] Date of Patent: Oct. 7, 1997

[54] MOTOR VEHICLE DOOR LOCK WITH CENTRAL LOCKING SYSTEM DRIVE

[75] Inventor: Martin Roos, Wuppertal, Germany

[73] Assignee: Bomoro Bocklenberg & Motte GmbH & Co. KG, Wuppertal, Germany

[21] Appl. No.: 554,654

[22] Filed: Nov. 8, 1995

[30] Foreign Application Priority Data

Aug. 11, 1994 [DE] Germany ..... 44 39 479.9

[51] Int. Cl.[6] ..... E05B 53/00

[52] U.S. Cl. ..... 70/264; 70/279; 292/201; 292/336.3

[58] Field of Search ..... 70/264, 279–283; 292/144, 201, 336.3

[56] References Cited

U.S. PATENT DOCUMENTS

| | | | |
|---|---|---|---|
| 4,518,181 | 5/1985 | Yamada | 292/201 |
| 4,588,217 | 5/1986 | Escaravage | 292/201 |
| 4,766,747 | 8/1988 | Ernest | 70/264 |
| 4,872,714 | 10/1989 | Brusasco | 292/201 |
| 4,904,006 | 2/1990 | Hayakawa et al. | 292/201 X |
| 4,905,528 | 3/1990 | Kawaguchi et al. | 292/201 X |
| 4,929,003 | 5/1990 | McConnell | 292/144 |
| 4,934,746 | 6/1990 | Yamada | 292/201 |
| 5,020,838 | 6/1991 | Fukumoto | 292/201 |
| 5,028,084 | 7/1991 | Fukumoto et al. | 292/337 |
| 5,062,312 | 11/1991 | Watanuki et al. | 74/89.14 |
| 5,199,288 | 4/1993 | Meriläinen et al. | 70/279 |
| 5,238,274 | 8/1993 | Becker et al. | 292/201 |
| 5,240,296 | 8/1993 | Kobayashi | 292/201 |
| 5,261,711 | 11/1993 | Mizuki et al. | 292/201 |
| 5,409,277 | 4/1995 | Rogers, Jr. et al. | 292/201 X |
| 5,439,261 | 8/1995 | O'Hare | 292/201 X |
| 5,453,671 | 9/1995 | Baier et al. | 292/144 X |
| 5,476,294 | 12/1995 | Menke | 292/201 X |
| 5,516,167 | 5/1996 | Hayakawa et al. | 292/201 X |
| 5,520,425 | 5/1996 | Dowling | 292/201 |
| 5,538,298 | 7/1996 | Ikeda | 292/201 |

FOREIGN PATENT DOCUMENTS

| | | |
|---|---|---|
| 1279080 | 1/1991 | Canada . |
| 0 192 239 | 2/1986 | European Pat. Off. . |
| 0 198 509 | 10/1986 | European Pat. Off. . |
| 0 684 356 A1 | 11/1995 | European Pat. Off. . |
| 1914724 | 10/1970 | Germany . |
| 3120000 | 12/1982 | Germany . |
| 3242527 | 5/1984 | Germany . |
| 3517981 A1 | 11/1986 | Germany . |
| 3540686 A1 | 5/1987 | Germany . |
| 8407253 | 1/1988 | Germany . |
| 3825909 A1 | 2/1990 | Germany . |
| 3923688 A1 | 1/1991 | Germany . |
| 4219211 | 12/1993 | Germany . |

(List continued on next page.)

*Primary Examiner*—Suzanne Dino
*Attorney, Agent, or Firm*—Sixbey, Friedman, Leedom & Ferguson, PC; David S. Safran

[57] ABSTRACT

A motor vehicle door lock with a central locking system drive and central locking system lever (3) driven by it, in which the central locking system drive is electromechanically operable in a reversible manner and has a drive element (4) with an eccentrically arranged driving lug (5) which can move in both directions of rotation in a circular path, a central locking system lever (3) that is pivotable about a pivot axis (7) which is parallel to the axis of rotation (6) of the drive element (4) and has a driving receiver (8) for driving lug (5) which is much wider than driving lug (5). The central locking system lever (3) can be swung into an unlocked position (E) and a locked position (V), by means of both the driving lug (5) and by manual operation in purely mechanically manner independently and unhindered by the driving lug. This motor vehicle door lock is characterized in that only approximately one half of the circular path of the driving lug (5) runs in the driving receiver (8) and the other half runs outside of the driving receiver (8), the axis of rotation (6) of the drive element (4) lies roughly at the open end of the driving receiver (8), and the driving lug (5) has rest positions outside of the driving receiver (8) and enters the driving receiver (8) only for movement of central locking system lever (3).

9 Claims, 7 Drawing Sheets

FOREIGN PATENT DOCUMENTS

| | | |
|---|---|---|
| 4343340 | 7/1994 | Germany . |
| 3-151480 | 6/1991 | Japan . |
| 4-277277 | 10/1992 | Japan . |
| 2 048 362 | 12/1980 | United Kingdom . |
| 2 282 637 | 12/1995 | United Kingdom . |
| WO 94/01644 | 1/1994 | WIPO . |

MOTOR VEHICLE DOOR LOCK WITH CENTRAL LOCKING SYSTEM DRIVE

BACKGROUND OF THE INVENTION

1. Field of the Invention

The invention relates to a motor vehicle door lock with a central locking system drive having a central locking system drive and a central locking system lever driven by the central locking system drive. In particular, to such a lock in which the central locking system drive is a reversible electromechanical drive having a drive element with an eccentrically arranged driving lug which is movable in opposite directions of rotation about an axis of rotation of the drive element, a central locking system lever mounted to pivot around a pivot axis which is parallel to the axis of rotation of the drive element and having a driving receiver for the driving lug which is wider than driving lug, the central locking system lever being pivotable around the pivot axis between an unlock position and a lock position both by means of the driving lug and also in a purely manually operated manner independent of and unhindered by said driving lug. Still further, to such a lock in which the driving lug has a path of movement approximately one half of which is within the driving receiver and the other half of which lies outside of the receiver, the axis of rotation of the drive element lying approximately on line with an open end of the receiver which opens into an open end of a motion receiver in the central locking system lever that has a width which is substantially greater than that of the driving receiver.

2. Description of Related Art

A conventional motor vehicle door lock generally has locking components, such as a rotary catch and detent pawl as well as lock mechanics located on a carrier element with different levers which are used for actuation. Currently, motor vehicle door locks with central locking system drives are common. A central locking system drive, generally, operates on a central locking system lever which is driven by it and which then, for its part, engages the closing mechanics, directly or via other interposed levers. In this case, all of this is irrelevant to the teaching of the invention; the teaching of the invention is concerned solely with the connection of the central locking system drive to the central locking system lever.

Prior art (published German Patent Application 42 19 211) discloses electromechanical execution of a reversible central locking system drive which works, therefore, in both directions of rotation. For this reason, there is a drive element with an eccentrically arranged driving lug which is driven by the electric motor of the central locking system drive, for example, via a spindle. Depending on the direction in which the motor turns, the direction in which the drive element turns is also different. When the drive element, which forms a type of crank mechanism turns, the driving lug also moves along a circular path in the respective direction of rotation.

In the above explained prior art, the central locking system lever can pivot around a pivot axis that is parallel to the axis of rotation of the drive element and projects with at its free end into the path of the driving lug on the drive element. If the drive element is caused to turn by the central locking system drive, the driving lug entrains the end of the central locking system lever until the latter reaches its unlock or lock position. After the end of this entraining movement for the central locking system lever, the driving lug does not remain stationary, for example, but instead continues to move in the same direction along its circular path. This is possible without undue force because the portion of the central locking system lever which projects into the rotary path of the driving lug is made elastically flexible so as to be able to be deflected by the driving lug, which continues to move, and until the lever is finally disengaged from the driving lug, at which point the lever springs back into its original position. The driving lug stops in a rest position which is outside of the range of motion of the central locking system lever, so that it is also possible to easily swing the central locking system lever back and forth by hand in a purely mechanical manner when the central locking system drive is blocked.

A different prior art motor vehicle door lock of similar design is known (published German Patent Application 43 43 340) in which the central locking system lever has a forked receiver for the driving lug, which is much wider than the driving lug itself, on its end which projects into the path of movement of the driving lug. The diameter of the drive element or the complete circular path of the driving lug corresponds roughly to the depth of the forked receiver, the driving lug thus always abuts a wall of the forked receiver. The forked receiver is so wide that the central locking system lever, regardless of the regular position of the driving lug in the forked receiver, can be moved purely mechanically back and forth between the unlock position and the lock position, independently and unhindered by the driving lug. Of course, this is a general requirement for motor vehicle door locks of the type under discussion which must be locked or unlocked with the driving lug in the rest position when the central locking system drive is blocked.

In the initially mentioned motor vehicle door lock, the spring construction of the central locking system lever has not proven itself very wear-resistant in practice. Conversely, in the second mentioned motor vehicle door lock, there is continuous engagement of the driving lug with the rigid central locking system lever which has the forked receiver, which leads the problem that starting of the electric motor of the central locking system drive must take place against spring force which loads the central locking system lever into its end positions (tipping spring). High starting currents of the central locking system drive are the result. In both cases, it is complicated that control of the central locking system drive must be exercised via microswitches which determine the position of the central locking system lever and the drive element.

In U.S. Pat. No. 5,240,296, a motor vehicle door lock system is disclosed having an operation lever with a Y-shaped recess within which an eccentric projection on a worm wheel drive disc is received, this projection driving the operation lever by engagement therewith in a triangular base leg of the Y-shaped recess (when the drive disc is rotated by a drive motor and worm gear spindle) but not engaging the operation lever in the rest position thereof within the arcuate arms of the Y-shaped recess (when the lock is locked or unlocked). Control of the movements of the door lock system is obtained by a position detection system having electric switches. However, the electric switches for controlling the movements of the door lock system are the source for many malfunctions.

SUMMARY OF THE INVENTION

A primary object of the invention is, therefore, to devise a generic motor vehicle door lock with a central locking system drive which ensures a continually loadable, wear-resistant coupling of the central locking system drive with the central locking system lever, and which permits largely force-free starting of the central locking system drive with circuitry which is structured as simply as possible.

More specifically, the present invention is directed to providing a central door lock system of the general type shown in the above-mentioned U.S. Pat. No. 5,240,296, but which eliminates as many of the control circuit switches thereof as is possible.

The aforementioned object is achieved in a motor vehicle door lock with the features initially mentioned by the arrangement wherein the motion receiver has stopping faces that are next to the open end of the driving receiver and which run in a circular arc about the pivot axis of the central locking system lever, the driving lug engaging against one of these stopping faces in a respective one of the locked and unlocked positions, engagement of the driving lug against the respective stopping face forming a means for controlling the operation of the central locking system drive. According to the invention, it has been recognized that, with a reversible central locking system drive, it is a prerequisite for the driving lug, in its rest positions, to be outside of the driving receiver even in a central locking system lever which is made stiff with the driving receiver. When the central locking system drive is restarted, the driving lug must first traverse a segment of its circular path until it reaches the side wall of the moving receiver in the central locking system lever and then moves it into the other position. Thus, the central locking system drive can start almost without force.

These and further objects, features and advantages of the present invention will become apparent from the following description when taken in connection with the accompanying drawings which, for purposes of illustration only, shows a single embodiment in accordance with the present invention.

DETAILED DESCRIPTION OF THE PREFERRED EMBODIMENT

The following explanations refer to only the part of the motor vehicle door lock which is important to the teaching of the invention, i.e., central locking system drive 1, 2 and central locking system lever 3 which is driven by it. Put another way, the manner in which a locking action is produced is immaterial to the invention, such being achieved by any known locking mechanism, and the invention being solely directed to the motive subsystem of an otherwise conventional motor vehicle lock. By way of example, the invention can be directly incorporated into the door lock system of U.S. Pat. No. 5,240,296, with the below-described central drive system lever of this invention replacing the operation lever described in this patent and thereby enabling the position detection device thereof to be eliminated (however, if a theft protection condition is still to be obtained, it would have to be provided by other means than positioning of the lug as described in that patent and such forms no part of this invention). To the extent necessary to complete an understanding of this invention, said U.S. Pat. No. 5,240,296 is hereby incorporated by reference.

Figure 1:
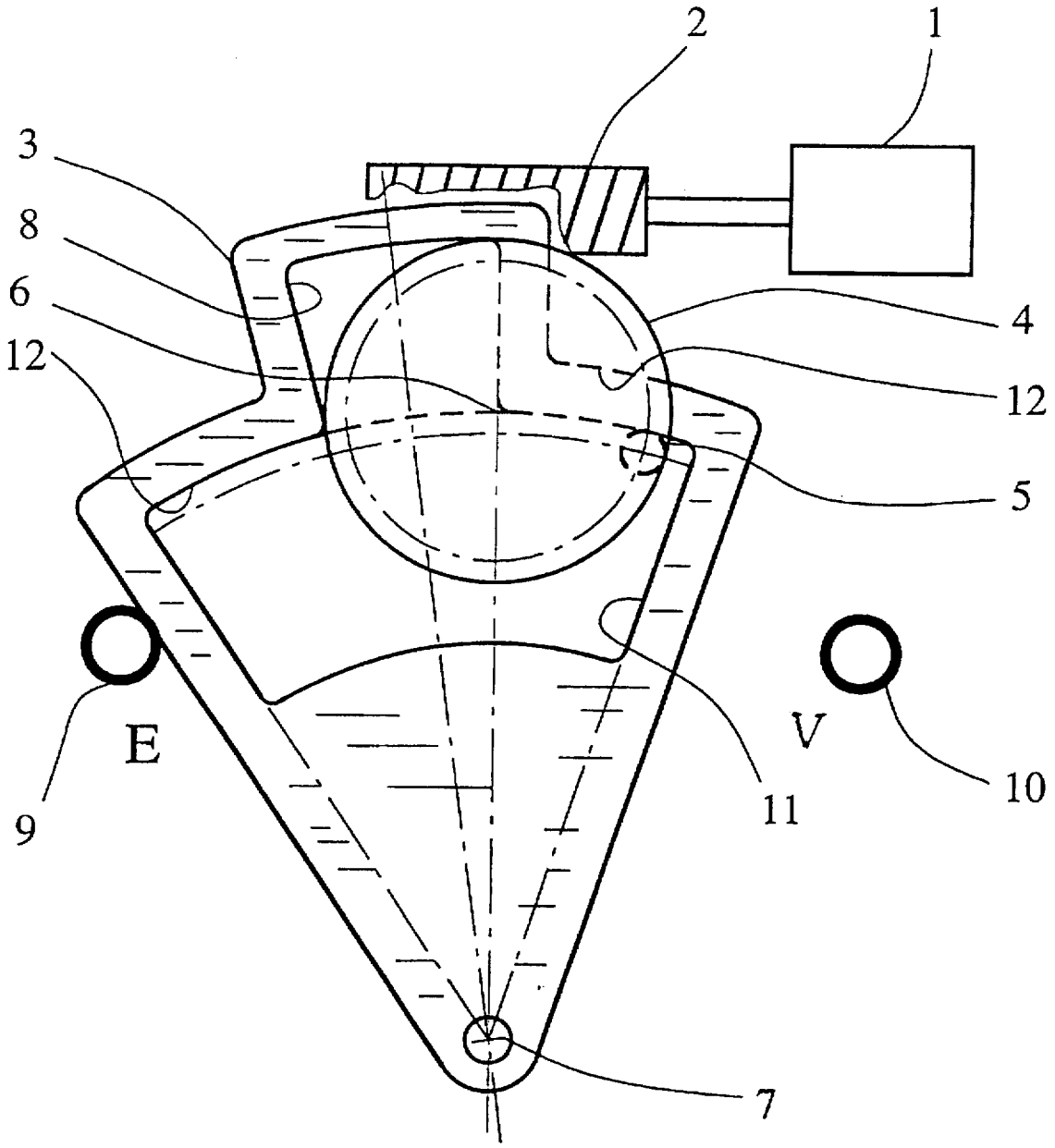
FIG. 1 shows a central locking system drive and central locking system lever of the motor vehicle door lock according to the invention in the unlocked position, the motor of the central locking system drive being stationary.

FIG. 1 shows central locking system drive with an electric drive motor 1 and a spindle 2 which is driven by it and which is shown here partially cut away in order to provide an unobstructed view of an underlying central locking system lever 3. A drive element 4 is provided in the form of a disk having an eccentrically arranged driving lug 5 for driving the central locking system lever 3. The disc of drive element 4 can be provided with teeth on the outside edge thereof with which spindle 2 of central locking system drive 1, 2 mates for rotating drive element 4 in a known manner or other conventional drive techniques can be used for this purpose.

Driving lug 5 follows a circular path of movement about rotational axis 6 of drive element 4 in both directions of rotation thereof, and together with the disk of drive element 4, forms a type of crank mechanism. The axis of rotation 6 of drive element 4 which can be physically present in the embodiment shown, can also be only virtually present, being indicated as the intersection of two hidden lines. Central locking system lever 3 can be swung around a pivot axis 7 which is parallel to axis of rotation 6. This swinging motion is the operating motion, which can be used in the locking mechanics (which as noted above are otherwise of conventional design and not further described) for locking or unlocking of the motor vehicle door lock (e.g., for releasing a detent pawl).

Central locking system lever 3 has driving receiver 8 for the driving lug 5 which is much wider than driving lug 5. As will be explained below, central locking system lever 3 can be swung into unlocked position E, shown in FIG. 1, and a locked position V, shown in FIG. 3, both by means of the driving lug 5 and also manually in purely mechanical manner independent of and unhindered by driving lug 5.

Stop 9 for unlocked position E and stop 10 locked position V are implemented in the described and preferred embodiment.

First of all, FIG. 1 clearly shows that only approximately one half (upper or lower) of the circular path of the driving lug 5 runs in driving receiver 8 and the other half of the circular path runs outside of the driving receiver 8, the axis of rotation 6 of the drive element 4, therefore, lying roughly on line with the open end of receiver 8 and stop surfaces 12 of a moving receiver 11 formed in lever 3. Thus, the driving lug 5 assumes its rest position or positions outside of receiver 8 and enters receiver 8 only for driving of central locking system lever 3. This has the advantages already addressed in the general part of the description.

Furthermore, FIG. 1 shows that, in the described and so far preferred embodiment, the unlocked position (E) and locked position (V) of central locking system lever (3) are each defined by a stop (9, 10). While in the embodiment according to FIG. 1, stops 9, 10 can be located anywhere outside of central locking system lever 3 and the outer surface of the central locking system lever 3 bumps against one stop 9, 10 at a time, there can also be equally well an internal implementation of stops 9, 10, specifically by the fact that a shaft forming the axis of rotation 6 of drive element 4 can simultaneously form an abutment member that engages inwardly positioned stops 9, 10. This can be easily imagined and such a stop arrangement is shown, e.g., in Japanese patent publication 4-277277.

Elimination of as many electronic components as possible is of major importance for building the motor vehicle door lock with central locking system drive 1, 2, with simple circuitry. For this reason, electric motor 1 preferably has an override mode where, e.g., power consumption by electric motor 1 is monitored and it is turned off when a certain limiting value is exceeded over a certain time; this means that powering of the motor is discontinued when movement of the drive disk is blocked by engagement of the lug 5 on one of the stop surfaces 12 of central locking system lever 3, causing the load on the motor to rise. Thus, the use of electrical switches can be abandoned for the most part.

The aforementioned override mode can, for example, be implemented by pressing the central locking system lever 3 against respective stop 9, 10. However this is not accomplished in the embodiment shown here, an override mode for electric motor 1 being implemented in the different manner to be explained below.

First of all, it should be further explained that in the embodiment described a driving receiver 8 in the central locking system lever 3 opens into a moving receiver 11 in central locking system lever 3, the moving receiver having a much greater width than the driving receiver 8. The driving lug 5 assumes its rest position or rest positions in the moving receiver 11. Receiver 8 could open radially outwardly with respect to central locking system lever 3, in which case the moving receiver 11 would adjoin driving receiver 8 radially outwardly thereof. However, in the described embodiment, a reverse arrangement is selected; specifically, it is provided that the open end of the driving receiver 8 faces pivot axis 7 of central locking system lever 3. But, this is not essential.

For both versions, it is possible that central locking system lever 3 is closed peripherally. The driving receiver 8 and moving receiver 11, therefore, are enclosed within central locking system lever 3. Moving receiver 11 provides a space for movement of driving lug 5 when lug 5 needs to return to its respective rest position which, for example, is shown for the unlocked position in FIG. 1. At the same time, moving receiver 11 ensures the capability, for unhindered manual swinging of central locking system lever 3 when the central locking system drive is stationary.

It has been explained previously which advantages the override mode of the central locking system drive has for circuitry simplification of the entire configuration. This is now accomplished in the described embodiment by a very simple concept of central locking system lever 3. As can be taken from FIG. 1, it is specifically provided that moving receiver 11 has stopping faces 12 which run preferably in a circular arc centered about pivot axis 7. The stopping faces 12 adjoin the sides of the driving receiver 8 at the open end thereof and the driving lug 5 bumps into a respective one of the stopping surfaces 12 in each rest position. These stopping faces 12 can also be provided with a driving receiver 8 which opens radially outwardly. The stopping surfaces 12 are of particular importance for the control of the central locking system drive that takes place by driving lug 5 bumping against the respective stopping face 12 to trigger the motor override mode.

In the described embodiment, furthermore, the driving receiver 8 of central locking system lever 3 is at least slightly wider on the open end than the radius of the disk 4 and therefore the distance to the outermost point of the driving lug 5.

How the motor vehicle door lock according to the invention works will become clear from the following explanation of operation in the motor vehicle door lock according to the invention using the figure sequence.

Figure 2:
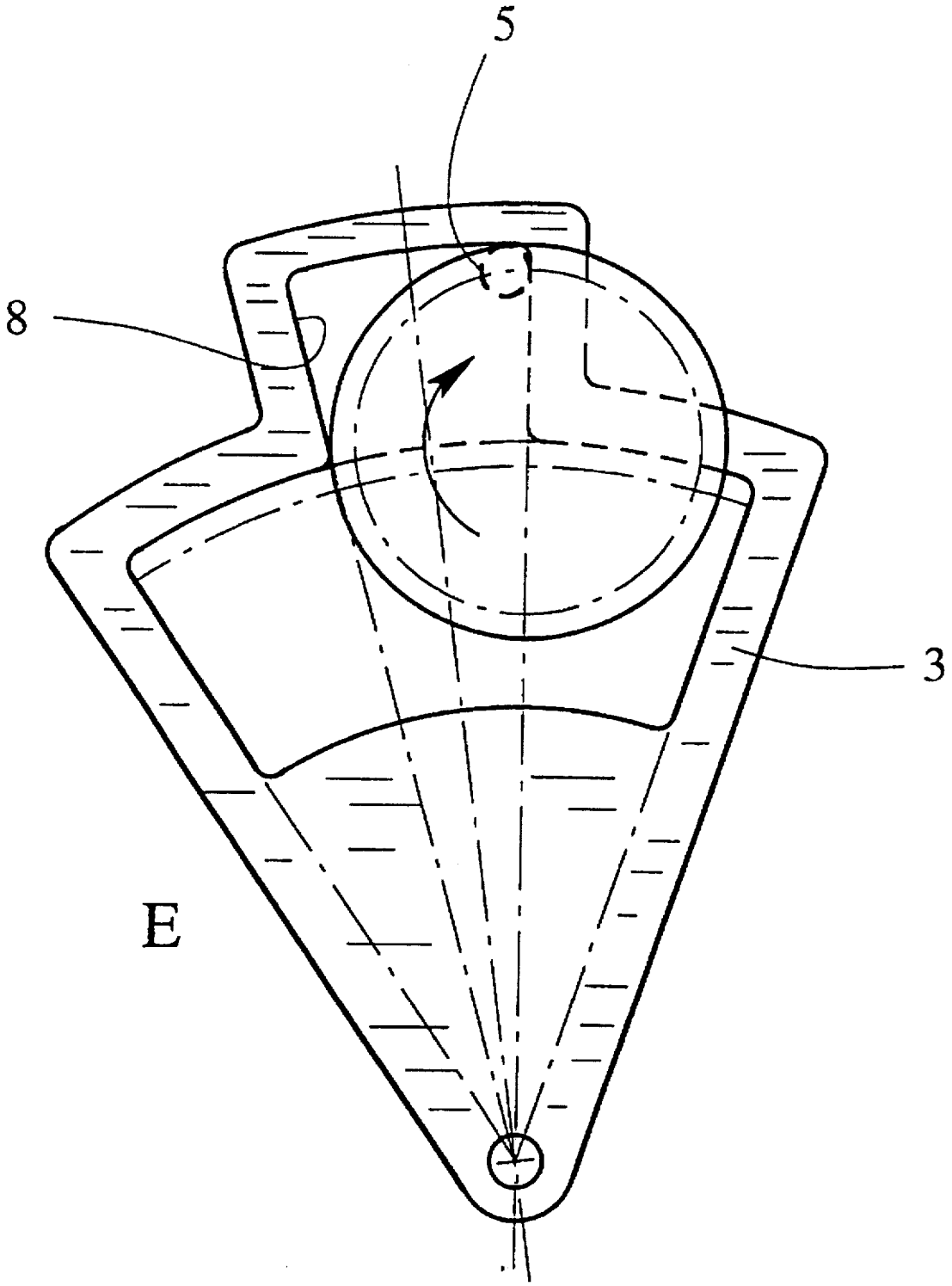
FIG. 2 shows the motor vehicle door lock from FIG. 1 with the motor running and the driving lug striking the side wall of the receiver for swinging the central locking system lever into the locked position.

In FIG. 1, the central locking system lever 3 is in the unlocked position, motor 1 of central locking system drive is stationary. If central locking system lever 3 should now be shifted into the locked position V, the electric motor 1 of central locking system drive 1, 2 is turned on. Motor 1 starts and drive element 4 begins to turn clockwise, as shown by the arrow in FIG. 2. Driving lug 5 runs clockwise in a circular path. Since the axis of rotation 6 of drive element 4 is located approximately on the right edge of driving receiver 8 and the open end of the receiver 8 end is slightly wider than the radius of drive element 4, driving lug 5 can enter the open end of the driving receiver 8 in an initially unhindered manner. As it continues to move clockwise, the lug 5 makes contact with the right side wall of the driving receiver 8 (FIG. 2). Driving lug 5 was able to execute this entire motion over an arc of almost 270° without any significant force, and the electric motor was therefore able to start without appreciable resistance.

Then, the driving lug 5 pushes the central locking system lever 3 clockwise from unlocked position E in FIG. 2 until the central locking system lever 3 reaches locked position V. At this point, driving receiver 8 has been pushed so far clockwise that the driving lug 5 can easily emerge again from the driving receiver 8 as it continues to move on its circular path with the driving element 4. Motor 1 continues to run unhindered, therefore in the interim no switching operations or the like have taken place. Microswitches are unnecessary here.

Since the stopping face 12 on the left of the driving receiver 8 lies in the further path of movement of driving lug 5, the driving lug 5 hits this stopping face 12 after a further path of 160°. Since this stopping face 12 runs roughly in a circular arc having its center at pivot axis 7, the force exerted by driving lug 5 on stopping face 12 is directed radially with respect to the pivot axis. Therefore, this force does not lead to any displacement of central locking system lever 3, it being undesirable for the lever to be displaced by such force. As a result, a considerable resistance is now offered to the drive motion of motor 1 by the engagement between the driving lug 5 and stopping face 12, so that the motor current jumps suddenly. This jump is evaluated by the drive circuitry, and the motor is turned off and becomes de-energized.

Due to the clever configuration of central locking system lever 3 in the motor vehicle door lock according to the invention, central locking system lever 3 can be easily swung back and forth by hand (mechanically) with the motor stationary and driving lug 5 against stopping face 12. For this purpose, it is especially desirable if the stopping faces 12 run in a circular arc according to the above described concept. It is apparent in FIG. 4 how central locking system lever 3 has been swung back manually from the locked position V shown in FIG. 3 into the unlocked position E. This can be necessary, for example, in emergency opening of a motor vehicle door lock. For relocking from the FIG. 4 position, such would occur as from the FIG. 1 position except that the lug 5 would only move through about 90° of arc before reaching the FIG. 2 position.

Figure 3:
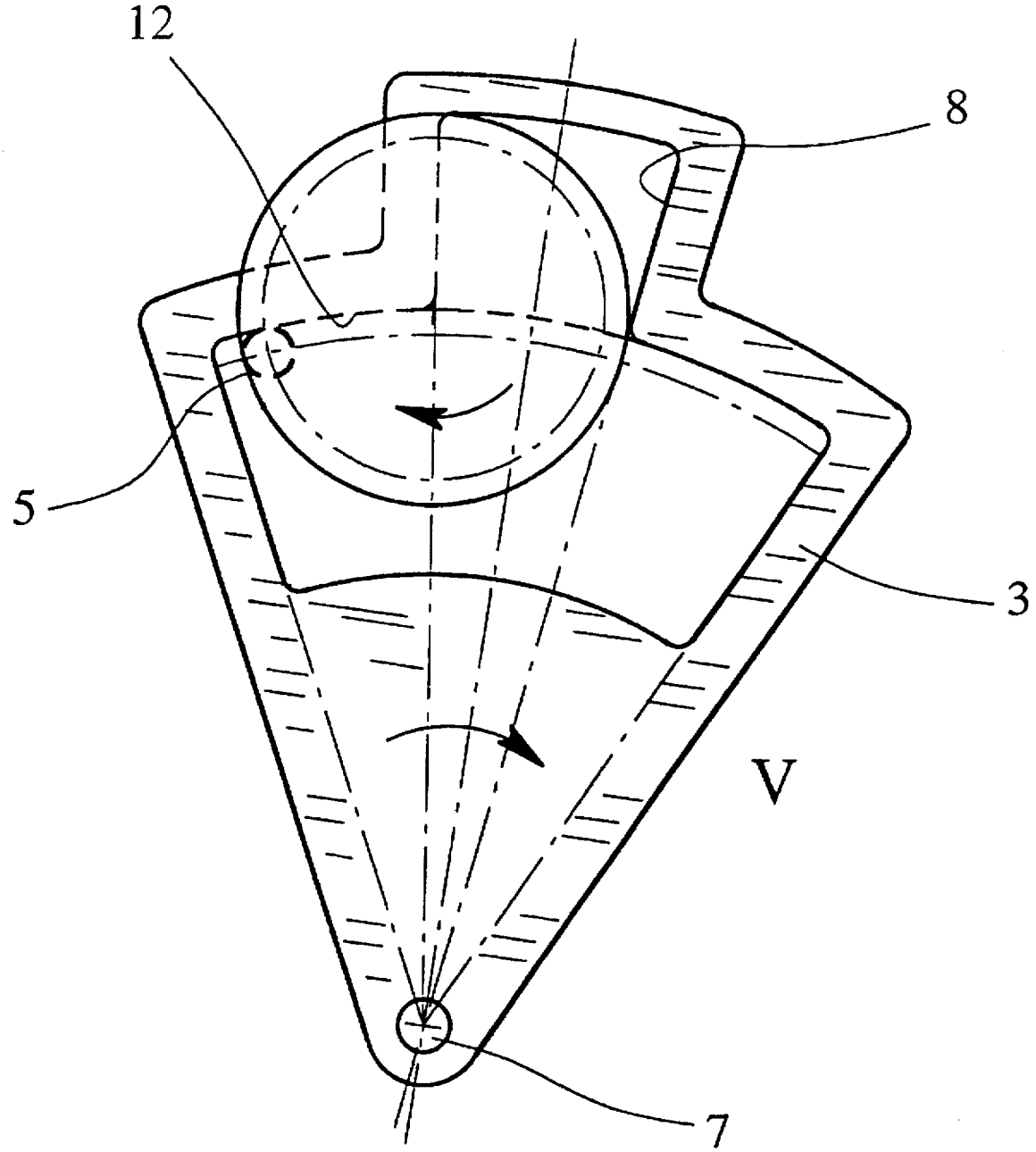
FIG. 3 shows the motor vehicle door lock from FIG. 2, now with the central locking system lever switched into locked position and the driving lug striking a stopping face.
Figure 4:
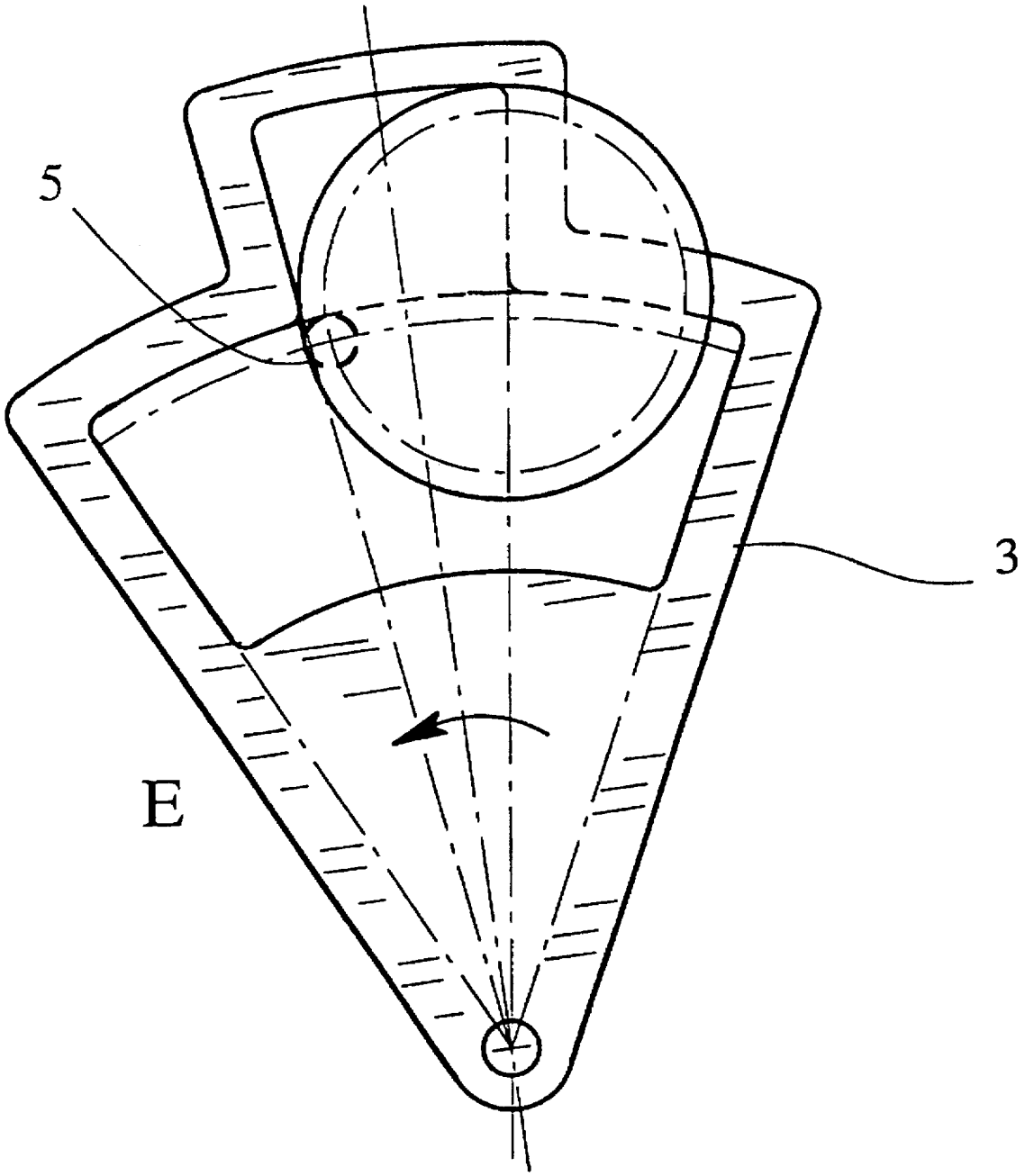
FIG. 4 shows the motor vehicle door lock from FIG. 3, the motor of the central locking system lever being stationary, the central locking system lever being shifted by hand into the unlocked position.
Figure 5:
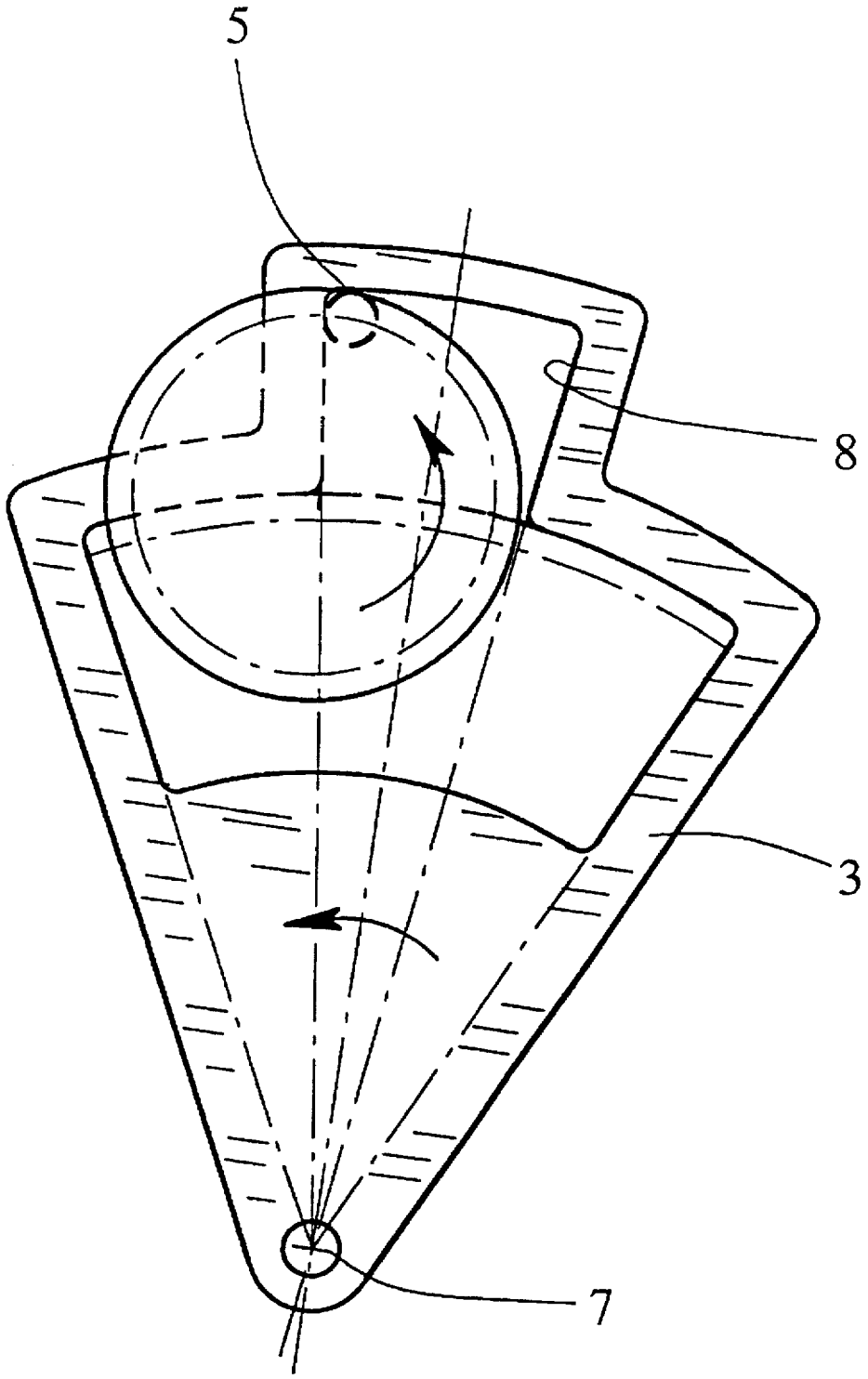
FIG. 5 shows the motor vehicle door lock from FIG. 3 with the central locking system lever being shifted by the central locking system drive back into the unlock position.

FIG. 5 shows the motor return drive motion for central locking system lever 3 from the FIG. 3 locked position. Driving lug 5 on drive element 4 has moved counterclockwise in a circular arc without resistance until reaching the position shown, after which it swings the central locking system lever 3 counterclockwise around pivot axis 7 from locked position V back into the unlocked position E.

Figure 6:
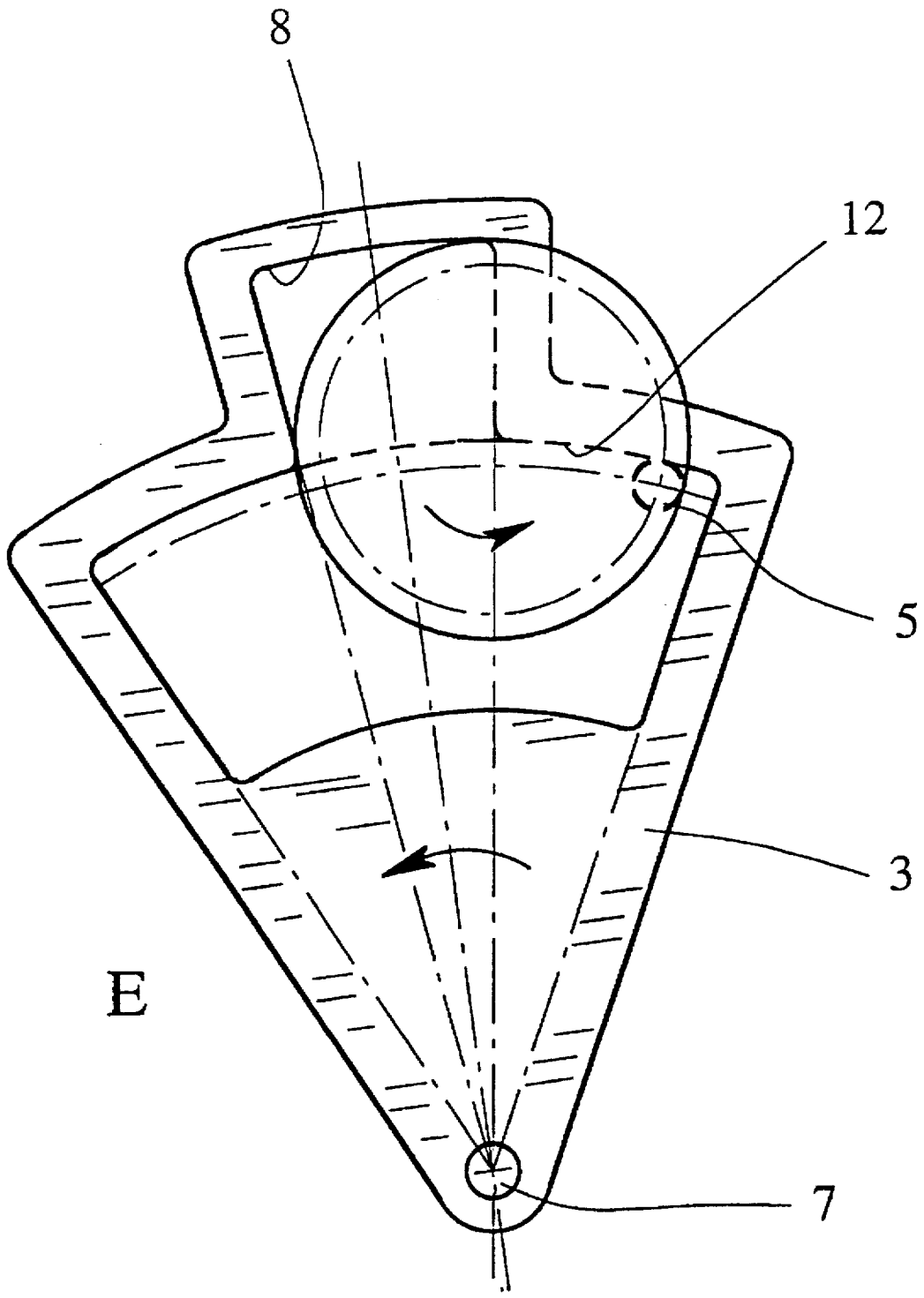
FIG. 6 shows the motor vehicle door lock from FIG. 5 after reaching the unlocked position and a rest position of the driving lug.
Figure 7:
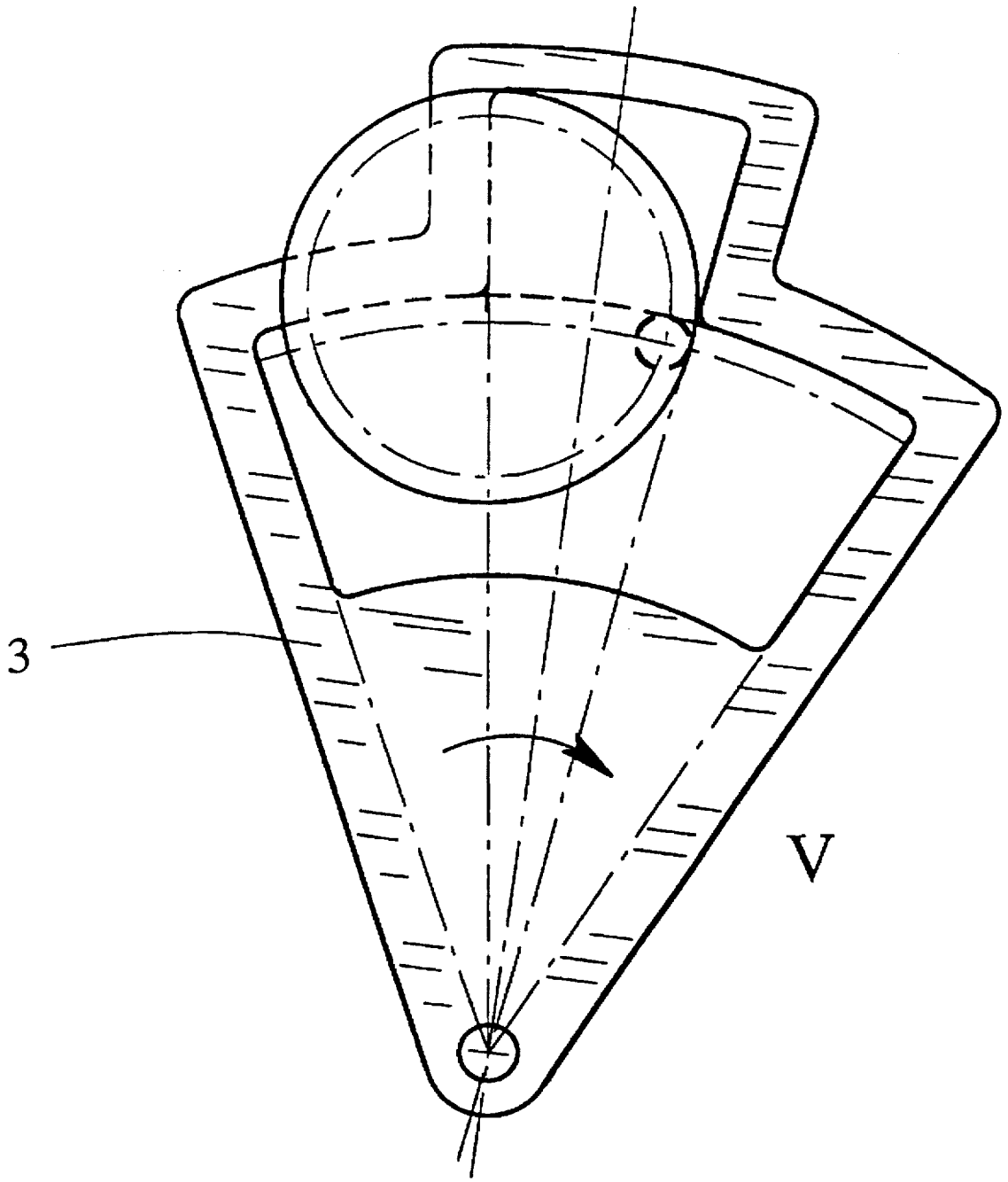
FIG. 7 shows the motor vehicle door lock from FIG. 6 after the central locking system lever has been shifted by hand into the lock position.

FIG. 6 shows the further movement of driving lug 5 after completion of the swinging of the central locking system lever 3 into the unlocked position E. Driving lug 5 now comes to rest against the stopping face 12 to the right of the moving receiver 11, so that then motor 1 is turned off thereby due to the increased motor current resulting from blocking of further movement of the lug 5. FIG. 7 then shows that unhindered mechanical swinging of the central locking system lever 3 is also possible also into this position from the FIG. 6 position.

The described design is especially interesting because central locking system lever 3 remains essentially unforced with respect to its motion between the unlocked position and the locked position, although considerable forces occur to allow electric motor 1 of the central locking system drive to be turned off via the override mode.

The motor vehicle door lock according to the invention is characterized by few parts, very high driving force, and a flat design. Motor 1 can be made relatively low-powered since it can start before significant forces are imposed on the driving lug 5. The fact that the override mode of the central locking system drive makes it possible to abandon microswitches for turning off electric motor 1 is especially important. Any position of central locking system lever 3 can be triggered quite easily both electromechanically and also manually.

While various embodiments in accordance with the present invention have been described and a preferred embodiment shown, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. A motor vehicle door lock comprising:

a central locking system drive and a central locking system lever driven by said central locking system drive, wherein the central locking system drive is a reversible electromechanical drive having a drive element with an eccentrically arranged driving lug which is movable in opposite directions of rotation about an axis of rotation of the drive element, wherein the central locking system lever is mounted to pivot around a pivot axis which is parallel to the axis of rotation of the drive element and has a driving receiver for the driving lug which is wider than the driving lug, said central locking system lever being pivotable around said pivot axis between an unlocked position and a locked position both by means of the driving lug and also in a purely manually operated manner independent of and unhindered by said driving lug;

wherein the driving lug has a path of movement approximately a first half of which is within the driving receiver and a second half of which lies outside of the receiver, wherein the axis of rotation of the drive element lies approximately on line with an open end of the receiver which opens into an open end of a moving receiver in the central locking system lever, the moving receiver having a width which is substantially greater than that of the driving receiver;

wherein the moving receiver has stopping faces next to the open end of the driving receiver which run in a circular arc about the pivot axis of the central locking system lever and against which the driving lug engages in respective one of the locked and unlocked positions, and wherein engagement of the driving lug against a respective stopping face forms a means for controlling operation of the central locking system drive by triggering a motor override mode in which power consumption of an electric motor of the central locking system drive is monitored and the motor is turned off when a limiting value is exceeded over a preset time period.

2. Motor vehicle door lock according to the preceding claim 1, wherein the unlocked position and the locked position of the central locking system lever are each defined by a stop; and wherein the driving lug forms a means for bringing the central locking system lever against a respective stop.

3. Motor vehicle door lock according to the preceding claim 1, wherein the driving receiver and the moving receiver are peripherally enclosed within the central locking system lever.

4. Motor vehicle door lock according to claim 3, wherein the open end of the driving receiver faces the pivot axis of the central locking lever.

5. Motor vehicle door lock according to claim 4, wherein the driving receiver of the central locking system lever is at least slightly wider on the open end than an outermost radius of the path of the driving lug.

6. Motor vehicle door lock according to claim 2, wherein the open end of the driving receiver faces the pivot axis of the central locking lever.

7. Motor vehicle door lock according to claim 6, wherein the driving receiver of the central locking system lever is at least slightly wider on the open end than an outermost radius of the path of the driving lug.

8. Motor vehicle door lock according to claim 1, wherein the open end of the driving receiver faces the pivot axis of the central locking lever.

9. Motor vehicle door lock according to claim 1, wherein the unlocked position and the locked position of the central locking system lever are each defined by a stop; and wherein a shaft forms the axis of rotation of the drive element and co-acts with said stops under the action of the driving lug upon the central locking system lever.

* * * * *